US010328397B2

(12) United States Patent
Perfette et al.

(10) Patent No.: US 10,328,397 B2
(45) Date of Patent: Jun. 25, 2019

(54) SYSTEMS AND METHODS FOR A WINE AERATION APPARATUS

(71) Applicants: Kyle Perfette, Peoria, AZ (US); Mindy Perfette, Peoria, AZ (US)

(72) Inventors: Kyle Perfette, Peoria, AZ (US); Mindy Perfette, Peoria, AZ (US)

( * ) Notice: Subject to any disclaimer, the term of this patent is extended or adjusted under 35 U.S.C. 154(b) by 216 days.

(21) Appl. No.: 15/342,474

(22) Filed: Nov. 3, 2016

(65) Prior Publication Data

US 2018/0117540 A1 May 3, 2018

(51) Int. Cl.
*B01F 3/04* (2006.01)

(52) U.S. Cl.
CPC ..... *B01F 3/04794* (2013.01); *B01F 3/0473* (2013.01); *B01F 2215/0072* (2013.01)

(58) Field of Classification Search
CPC ..... A47G 2400/045; B01F 3/04794; B01F 3/0473; B01F 2215/0072
See application file for complete search history.

(56) References Cited

U.S. PATENT DOCUMENTS 445,057 A * 1/1891 Harroun ..... B65F 1/163 220/23.87
1,060,419 A * 4/1913 Benjamin ..... B01F 7/00408 366/130
1,340,886 A * 5/1920 Galleguillos ..... A47G 19/2266 215/385
2,962,201 A * 11/1960 Brillis ..... B65D 23/04 229/400
2,965,274 A * 12/1960 Brillis ..... B01F 11/0002 229/400
2,988,258 A * 6/1961 Witzke ..... B65D 1/265 206/519
3,138,371 A * 6/1964 Feher ..... B65D 3/28 206/217
3,400,855 A * 9/1968 Alexander ..... A47G 19/2211 215/6
4,003,555 A * 1/1977 Swartz ..... A47J 43/27 220/568
4,768,674 A * 9/1988 Prescott ..... A47G 19/2211 220/719
5,293,912 A * 3/1994 Wildash ..... A47G 23/00 141/106
5,370,258 A * 12/1994 Fair ..... A47G 19/2211 220/501
5,579,962 A * 12/1996 Chen ..... B65D 23/00 222/564
5,713,263 A * 2/1998 Burks, III ..... B01F 3/0446 99/277.2
5,746,113 A * 5/1998 Ko ..... A47G 19/16 99/279
5,913,964 A * 6/1999 Melton ..... A47G 19/16 99/322

(Continued)

FOREIGN PATENT DOCUMENTS

EP 1994862 A1 * 11/2008 ..... A47G 19/2205
FR 2648340 A1 * 12/1990 ..... A47G 19/2205

(Continued)

*Primary Examiner* — Stephen Hobson
(74) *Attorney, Agent, or Firm* — Polsinelli PC

(57) ABSTRACT

Embodiments of an aerator apparatus having an aerator insert disposed within a container, such as a glass, are disclosed.

11 Claims, 2 Drawing Sheets

(56) References Cited

U.S. PATENT DOCUMENTS 6,409,374 B1 * 6/2002 Willat ..... A47G 19/2205 206/520
6,502,712 B1 * 1/2003 Weber-Unger .... A47G 19/2205 220/23.83
7,543,717 B2 * 6/2009 Hinkle ..... A47G 19/2205 220/508
7,717,610 B2 * 5/2010 Schlebach ..... A47G 23/06 366/130
8,101,222 B2 * 1/2012 Burroughs ..... A47G 19/2205 206/217
8,205,541 B2 * 6/2012 Barberio ..... B01F 3/0446 222/566
8,757,048 B2 * 6/2014 Burroughs ..... A47G 19/2205 220/703
8,894,042 B2 * 11/2014 Kilduff ..... A47G 19/2205 261/115
8,936,388 B2 * 1/2015 Kossovsky ..... A47J 43/27 366/130
9,022,250 B2 * 5/2015 Stern ..... A47G 19/2205 220/719
9,242,793 B1 * 1/2016 Ross ..... B65D 88/42
9,399,197 B2 * 7/2016 Graham ..... B01F 5/0428
9,511,332 B2 * 12/2016 Zimmerman ..... A47J 36/165
9,938,491 B2 * 4/2018 Castanon Delgado .. C12G 1/00
2007/0199612 A1 * 8/2007 Larimer ..... B65D 81/2038 141/65
2010/0025867 A1 * 2/2010 Benton ..... A47G 23/00 261/110
2012/0272831 A1 * 11/2012 Barberio ..... B01F 3/0446 99/323.1
2014/0103042 A1 * 4/2014 Tavenner ..... A47G 19/12 220/216
2015/0343400 A1 * 12/2015 Stevenson ..... B01F 3/04106 261/30
2016/0030898 A1 * 2/2016 Devoy ..... B65D 1/02 215/40
2016/0339398 A1 * 11/2016 Stevenson ..... B01F 13/002

FOREIGN PATENT DOCUMENTS

FR 2953110 B1 * 2/2012 ..... A47G 19/2205
WO WO-2009122234 A2 * 10/2009 ..... A47G 23/00
WO WO-2009126555 A2 * 10/2009 ..... A47G 19/2272
WO WO-2011162979 A2 * 12/2011 ..... B65D 47/06
WO WO-2012028722 A1 * 3/2012 ..... A47G 21/00
WO WO-2013166181 A2 * 11/2013 ..... B01F 3/04241

* cited by examiner

SYSTEMS AND METHODS FOR A WINE AERATION APPARATUS

FIELD

The present document relates to a system for aerating wine, and in particular to systems and method for a wine aeration apparatus having a glass with an aeration insert disposed therein for aerating wine.

Wine is an alcohol beverage made from fermented grapes or other kinds of fruit. Wine tasting is a sensory examination and evaluation of wine. Prior to tasting wine, certain wines can benefit from being aerated by either decanting the wine or aerating the wine using a wine accessory. During aeration, a younger wine's exposure to air often "relaxes" the drink, thereby making it smoother and better integrated in aroma, texture, and flavor. In particular, wine accessories that conveniently aerate wine may be desired in the absence of a decanter or more expensive wine accessory. As such, there is a need in improvements in wine accessories, such as aeration apparatuses, that allow for convenient aeration of wine without a decanter.

BRIEF DESCRIPTION OF THE DRAWINGS

Corresponding reference characters indicate corresponding elements among the view of the drawings. The headings used in the figures do not limit the scope of the claims.

DETAILED DESCRIPTION

Figure 1:
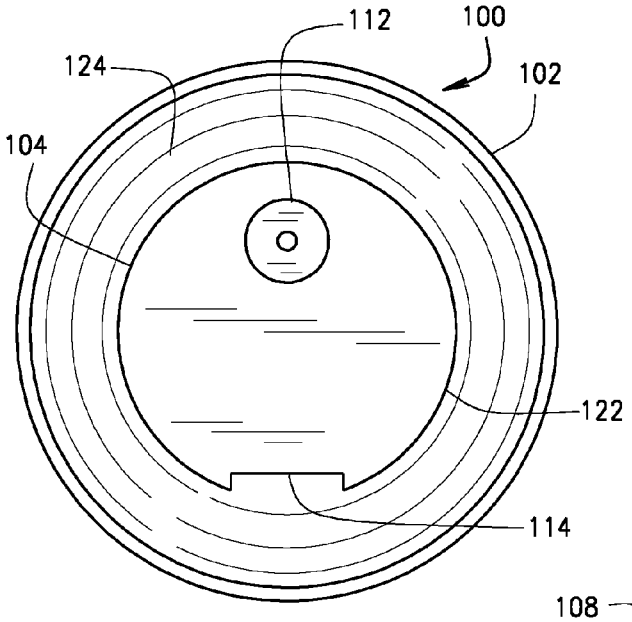
FIG. 1 is a top view of one embodiment for a wine aeration apparatus having a glass with an aeration insert disposed within the glass for allowing wine to be aerated when the glass is tiled at an angle.
Figure 2:
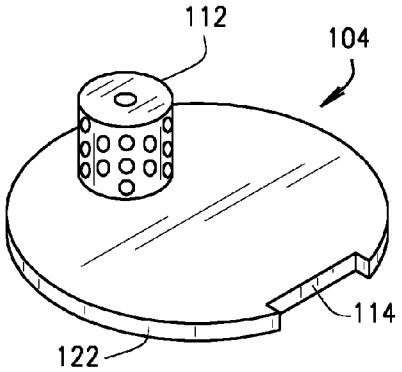
FIG. 2 is a perspective view of the aeration insert shown in FIG. 1.

Embodiments of a wine aeration apparatus comprising a glass with an aeration insert disposed within the glass for aerating wine are described herein. The aeration insert may have an aeration body that is configured to be inserted into the glass and retained therein for allowing wine to be aerated when being poured out from the glass. Referring to the drawings, an embodiment of the wine aeration apparatus are illustrated and generally indicated as 100 in FIGS. 1-8.

Figure 7:
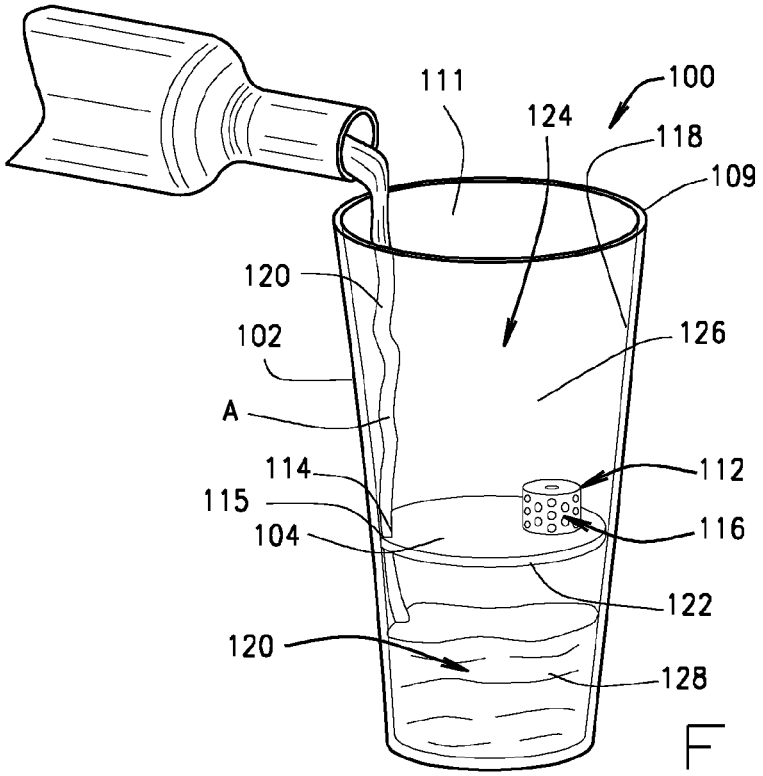
FIG. 7 is a side view of the wine aeration apparatus of FIG. 1 illustrating wine being poured through the aeration insert.
Figure 8:
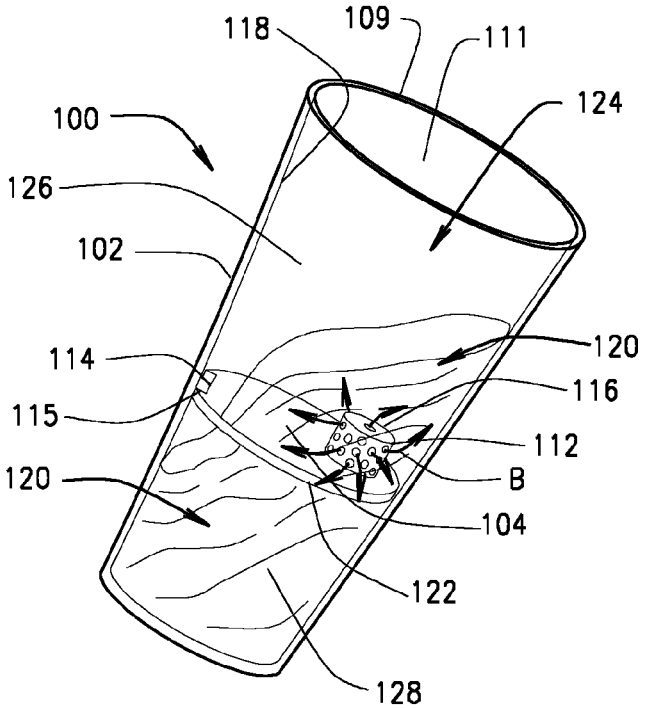
FIG. 8 is a side view of the wine aeration apparatus of FIG. 7 illustrating the poured wine being aerated through the aeration insert.

As shown in FIGS. 1, 7 and 8, one embodiment of the wine aeration apparatus 100 includes a glass 102 configured to receive an aeration insert 104 therein for aerating wine as shall be discussed in greater detail below. In some embodiments, the glass 102 may have a generally tapered glass body 107 that defines a peripheral lip 109 forming an opening 111. In addition, the opening 111 is in communication with an interior surface 118 that forms an interior portion 124 configured to receive the aeration insert 104 such that the aeration insert 104 contacts the interior surface 118 of the glass 102.

Referring to FIGS. 2-6, the aeration insert 104 may have a generally circular-shaped insert body 106 configured to be inserted through the opening 111 of the glass 102. The insert body 106 forms a top portion 108 and a bottom portion 110 with a peripheral edge 122 formed around the periphery of the aeration insert 104.

Figure 3:
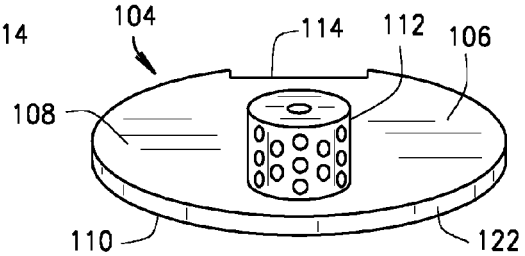
FIG. 3 is a side view of the aeration insert of FIG. 2.
Figure 4:
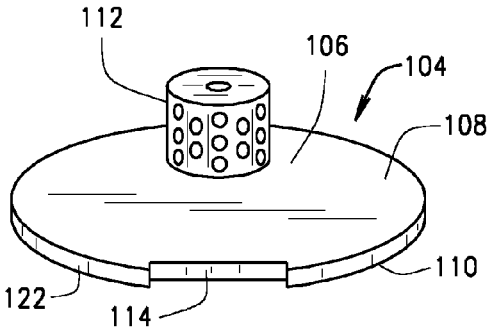
FIG. 4 is an opposing side view of the aeration insert shown in FIG. 3.
Figure 5:
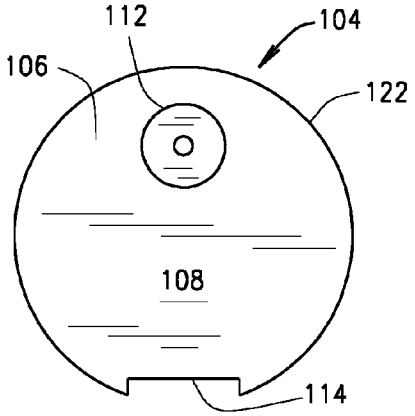
FIG. 5 is a top view of the aeration insert of FIG. 2.
Figure 6:
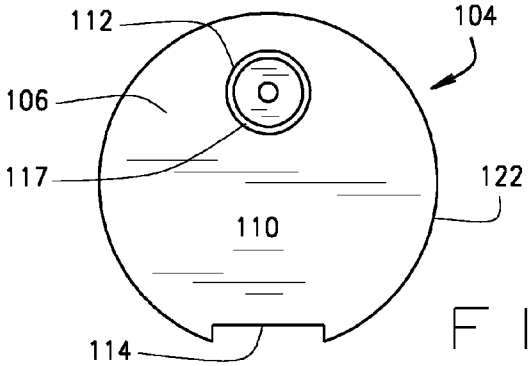
FIG. 6 is a bottom view of the aeration insert of FIG. 2.

Referring to FIG. 5, the aerator insert 104 includes an aerator 112 that extends outwardly from the top portion 108 of the insert body 106. The aerator 112 defines a plurality of apertures 116 that communicate with an inner portion 117 (FIG. 6) formed by the aerator 112 as illustrated in FIGS. 3 and 4. During aeration, the plurality of apertures 116 allows the wine to be aerated when the glass 102 is oriented at an angle that permits the wine to flow from the inner portion 117 to the top portion of the aerator insert 104.

As shown in FIGS. 2 and 4-8, the peripheral edge 122 of the aeration insert 104 defines a notch 114. The notch 114 of the aeration insert 104 collectively forms an opening with the interior surface 118 of the glass 102, which allows the flow of wine from the top interior portion 126 to the bottom interior portion 128 of the glass 102 as illustrated in FIG. 7.

Referring to FIGS. 7 and 8, the peripheral edge 122 of the aeration insert 104 is configured to contact the interior surface 118 of the glass 102 in a frictional engagement such that the aeration insert 104 is wedged tightly within the glass 102. In some embodiments, peripheral edge 122 of the aeration insert 104 is engaged to the interior surface 118 of the glass 102 by an epoxy, a non-toxic FDA-approved silicone glue, or a tight frictional fit between the glass 102 and the aeration insert 104. In other embodiments, the aeration insert 104 may be made integral with the glass 102 during manufacturing of the wine aeration apparatus 100.

In some embodiments the glass 102 may have an interior surface 118 with a generally tapered configuration which allows the aeration insert 104 to be inserted into the interior portion 124 of the glass 102 until the peripheral edge 122 establishes a tight frictional contact with the interior surface 118 such that the aeration insert 104 is not easily dislodged. In some embodiments, the interior surface 118 may have a generally straight configuration, a curved configuration, a generally asymmetrical configuration, or a generally symmetrical configuration configured to engage the aeration insert 104.

In one method of use, wine may be poured through the opening 115 of the aeration insert 104 as illustrated by fluid flow A in FIG. 7 and allowed to collect within the bottom interior portion 128 of the glass 122. Once sufficient wine is collected, the glass 102 may be tipped at an angle such the collected wine flows from the bottom interior portion 128 and into the top interior portion 126 through the plurality of apertures 116 of the aerator 112 as indicated by fluid flow B in FIG. 8. The action of the wine flowing through the plurality of apertures 116 aerates the wine as it enters the top interior portion 116 of the glass 102. Once aerated, the wine may be poured into another glass or drank directly from the glass 102.

In another method of use, the glass 102 may be tipped at an angle such that the poured wine collects within the top interior portion 126 of the glass 102 around the aerator 112 when poured into the glass 102, thereby causing the wine to flow through the plurality of apertures 116 and into the bottom interior portion 128. Once aerated, the wine may be poured either back through the aerator 112 or through the opening 115.

It should be understood from the foregoing that, while particular embodiments have been illustrated and described, various modifications can be made thereto without departing from the spirit and scope of the invention as will be apparent to those skilled in the art. Such changes and modifications are within the scope and teachings of this invention as defined in the claims appended hereto.

What is claimed is:

1. An aerator insert comprising:

an insert body having a substantially round configuration, the insert body defining a top portion and an opposite bottom portion with a peripheral lip;

an aerator extending outwardly from the top portion of the insert body and defining an interior chamber, the aerator defining a plurality of apertures in communication with the interior chamber; and an opening defined through the insert body, wherein the opening is formed along the peripheral lip of the insert body, and wherein the opening is discretely formed a predetermined distance from the aerator along the top portion of the insert body and separated from the aerator by a portion of the insert body, wherein the aerator terminates along the top portion of the insert body.

2. The aerator insert of claim 1, wherein the aerator is formed proximate the peripheral lip of the insert body.

3. The aerator insert of claim 1, wherein the aerator defines an opening in communication with the interior chamber.

4. The aerator insert of claim 1, wherein the opening defines a notch formed along the peripheral lip of the insert body.

5. An aerator apparatus comprising:

a glass defining an interior portion including a bottom interior portion and a top interior portion;

an aerator insert configured to be received within the interior portion of the glass between the bottom interior portion and the top interior portion of the glass, the aerator insert comprising:

an insert body having a substantially round configuration, the insert body defining a top portion and an opposite bottom portion with a peripheral lip;

an aerator extending outwardly from the top portion of the insert body such that the bottom interior portion of the glass is devoid of the aerator, the aerator defining an interior chamber and defining a plurality of apertures in communication with the interior chamber; and an opening defined through the insert body, wherein the opening is formed along the peripheral lip of the insert body.

6. The aerator apparatus of claim 5, wherein the aerator insert defines the top interior portion and the bottom interior portion within the interior portion of the glass.

7. The aerator apparatus of claim 6, wherein the bottom interior portion is substantially enclosed and the top interior portion is in communication with an opening of the glass.

8. The aerator apparatus of claim 5, wherein the aerator is formed proximate the peripheral lip of the insert body.

9. The aerator apparatus of claim 5, wherein the aerator defines an opening in communication with the interior chamber.

10. The aerator apparatus of claim 5, wherein the aerator insert is formed integral with the glass.

11. An aerator apparatus comprising:

a glass defining an interior portion including a bottom interior portion and a top interior portion;

an aerator insert configured to be received within the interior portion of the glass between the bottom interior portion and the top interior portion of the glass, the aerator insert comprising:

an insert body having a substantially round configuration, the insert body defining a top portion and an opposite bottom portion with a peripheral lip;

an aerator extending outwardly from the top portion of the insert body such that the bottom interior portion of the glass is devoid of the aerator, the aerator defining an interior chamber and defining a plurality of apertures in communication with the interior chamber; and an opening defined through the insert body, wherein the opening is formed opposite the aerator along the top portion of the insert body.

* * * * *